US005993105A

United States Patent [19]

Chan

[11] Patent Number: 5,993,105

[45] Date of Patent: Nov. 30, 1999

[54] STACKABLE WIND-RESISTANT SAFETY MARKER

[76] Inventor: Steven R. Chan, 1132 Isabella Ave., Monterey Park, Calif. 91754

[21] Appl. No.: 09/150,781

[22] Filed: Sep. 10, 1998

[51] Int. Cl.[6] ..... E01F 9/017

[52] U.S. Cl. ..... 404/10; 404/9; 116/63 C; 116/173

[58] Field of Search ..... 404/6, 9, 12, 10; 116/63 R, 63 P, 63 C, 173, 63 T, 303

[56] References Cited

U.S. PATENT DOCUMENTS

| | | | |
|---|---|---|---|
| 2,002,756 | 5/1935 | Segelhorst . | |
| 2,275,711 | 3/1942 | Ybanez . | |
| 2,333,273 | 11/1943 | Scanlon . | |
| 2,800,099 | 7/1957 | Baker . | |
| 2,808,803 | 10/1957 | Weig . | |
| 3,099,244 | 7/1963 | Knapp . | |
| 3,386,409 | 6/1968 | Dawson . | |
| 3,618,556 | 11/1971 | Dittrich . | |
| 3,732,842 | 5/1973 | Vara, Sr. . | |
| 4,925,334 | 5/1990 | Beard . | |
| 5,749,673 | 5/1998 | Kulp et al. | 116/63 C |

FOREIGN PATENT DOCUMENTS

| | | | |
|---|---|---|---|
| 0325255 | 7/1989 | European Pat. Off. | 116/63 C |
| 2108182 | 5/1983 | United Kingdom | 116/63 R |
| 2122239 | 1/1984 | United Kingdom | 116/63 C |

*Primary Examiner*—Thomas B. Will
*Assistant Examiner*—Kristine Markovich
*Attorney, Agent, or Firm*—Sheldon & Mak

[57] ABSTRACT

A safety marker includes an hollow frusto-conical body; a base having an bowl-shaped main portion and a resiliently flexible skirt for yieldably stabilizing the marker against tipping relative to a supportive surface, the body being connected in upstanding relation to an inner portion of the base and concentric therewith, the base being formed to clear the cone defined by the inside surface of the body, the bowl being sufficiently large relative to the body and the base being weighted sufficiently that the marker is self-righting, the skirt being sufficiently flexible to be deflected against the bowl for preserving the self-righting capability of the marker. A flag supported relative to the body is movable between a deployed position projecting from the body and a storage position extending proximate the outer surface of the body, the flag being biased into the deployed position, whereby the storage position is attained and maintained in the stacked condition by the adjacent marker and the deployed position is attained and maintained upon unstacking of the adjacent marker, identical counterparts of the safety marker being stackable with the outside body surface of one marker being in proximate contact with the inside body surface of an adjacent marker.

13 Claims, 2 Drawing Sheets

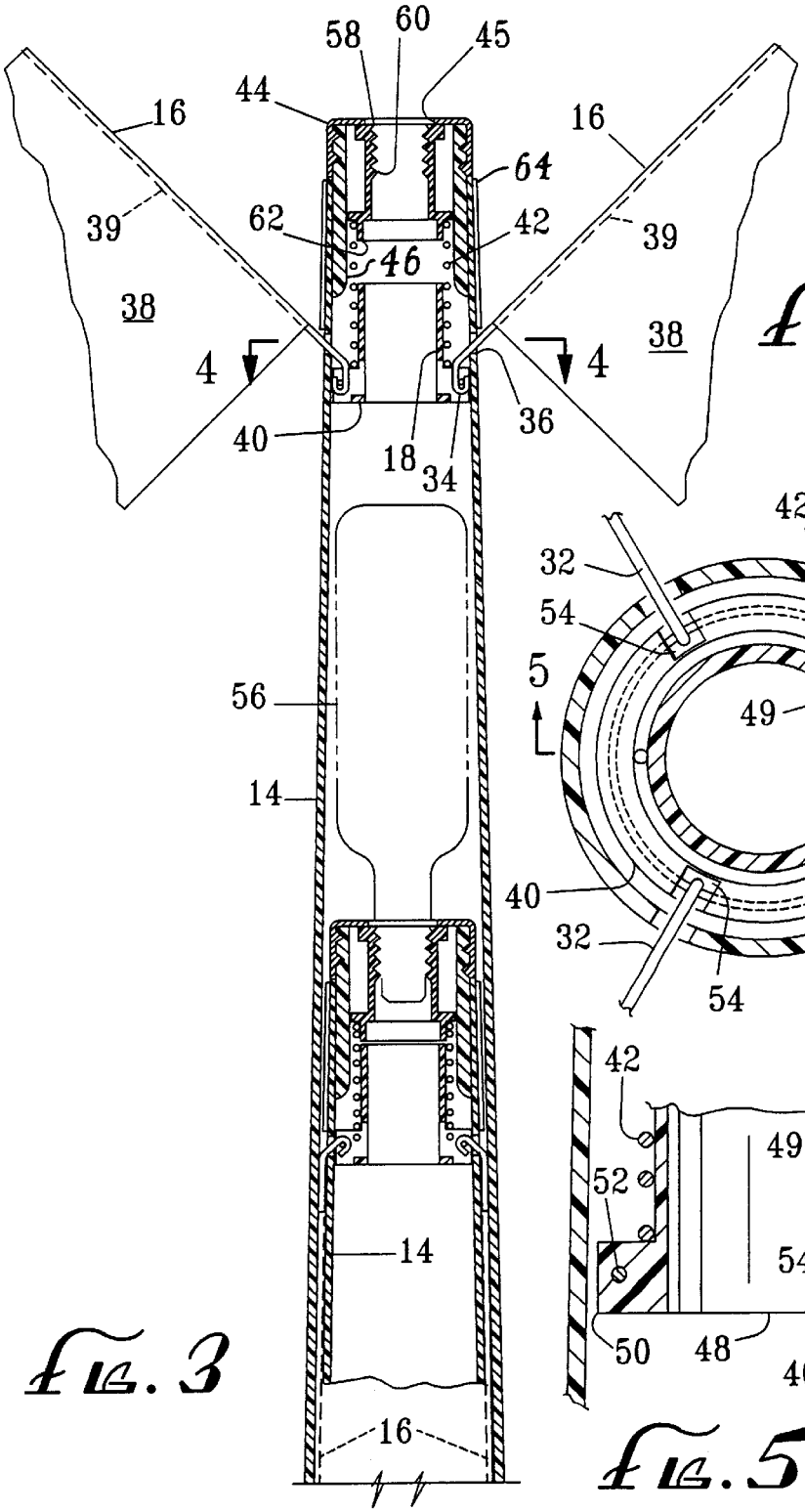
FIG. 3
FIG. 4
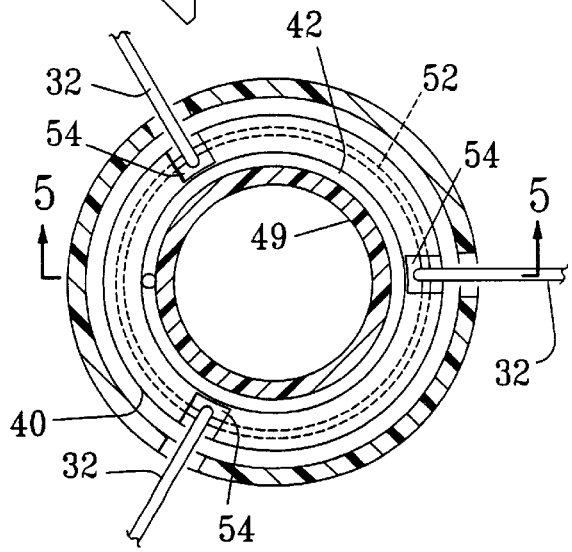
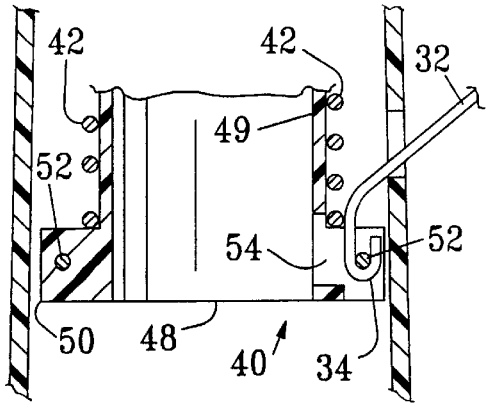
FIG. 5

STACKABLE WIND-RESISTANT SAFETY MARKER

BACKGROUND

The present invention relates to safety markers of the type used at highway construction sites, for warning vehicle drivers of obstructions, dangerous conditions, etc.

Many of the safety markers in common use are molded from brightly colored synthetic rubber or other plastic, in the form of elongate, truncated hollow cones having a relatively small opening at the top and an outwardly extending flange at the bottom. See, for example, U.S. Pat. No. 2,333,273 to Scanlon. These conventional marker cones are stackable for compact storage, and they can be delivered from a stack upright onto the ground from a moving vehicle; however, they are subject to being knocked over or blown over by high winds, and they are not self-righting. Also, they are undesirably heavy and bulky when made sufficiently large to be effective as a safety marker.

As a result of the above, a number of different marker configurations have been proposed. U.S. Pat. No. 3,386,409 to Dawson discloses a self-righting traffic cone having a hollow frusto-conical body and an outwardly and upwardly curved base rocker portion, the cone being self-righting and stackable. U.S. Pat. No. 2,275,711 to Ybanez discloses an axially collapsible cone that is pivotally connected and releasably latched to a platform base, a flag projecting upwardly from the cone. U.S. Pat. No. 4,925,334 to Beard discloses a traffic marker cone having a hangar for supporting an upwardly and outwardly projecting flag, the flag and the hangar being storable within the cone. None of the safety markers of the prior art is entirely satisfactory; for example:

1. The cone of Dawson can easily be blown partially over by the wind, being then subject to being rotated on its axis blown along for considerable distances out of position;
2. The safety signal of Ybanez requires complicated manual operations for deployment and collapsing, and is not self-righting; and
3. The marker of Beard suffers from the disadvantages of the device of Ybanez, and further that it is not stackable together with the hangar and flag.

Thus there is a need for a safety marker that is both stable and self-righting, having a large attention-commanding presence but a compact stackable configuration, and that can be easily deployed and stacked without manual assembly or disassembly.

SUMMARY

The present invention meets this need by providing a stackable safety marker that in its most preferred embodiments has a skirted self-righting base and flip-up flags. In one aspect of the invention, a safety marker for identifying road hazards and the like includes an elongate hollow frusto-conical body member having an outside surface and an inside surface, the inside surface defining a cone; a base having an annular bowl-shaped main portion, the body member being connected in upstanding relation to an inner portion of the base and concentric therewith, the base being formed to clear the cone defined by the inside surface of the body member, the bowl portion being sufficiently large relative to the body member and the base being weighted sufficiently that the marker is self-righting, wherein identical counterparts of the safety marker are stackable with the outside body surface of one marker being in proximate contact with the inside body surface of an adjacent marker.

The base can include a resilient wall member and a weight element filling a bottom portion of the bowl portion. Preferably, an upper surface of the base is upwardly concave for nesting with the bowl portion of the adjacently stacked safety marker. Preferably the weight element includes at least 80 percent of a total weight of the safety marker for enhanced stability. The weight element can include a multiplicity of fragments having a preferred density of at least approximately 0.3 pounds per cubic inch for enhanced stability in compact configurations of the base relative to an overall size of the marker, the weight elements being imbedded in a resilient binder. The binder can be adhesively bonded to the wall member.

Preferably the wall member forms a resiliently flexible skirt portion extending concentrically outwardly and downwardly from the bowl portion for yieldably stabilizing the marker against tipping relative to a supportive surface, a perimeter extremity of the skirt portion being approximately flush with a bottom extremity of the main portion, the skirt portion being sufficiently flexible to be deflected against the bowl portion for preserving the self-righting capability of the marker.

The safety marker can further include a flag member supported relative to the body member and movable between a deployed position projecting from the body member and a storage position extending proximate the outer surface of the body member; and means for biasing the flag member into the deployed position, whereby the storage position is attained and maintained in the stacked condition by the adjacent marker and the deployed position is attained and maintained upon unstacking of the adjacent marker.

In another aspect of the invention, the safety marker includes the elongate hollow frusto-conical body member; the base having the annular bowl-shaped main portion and the resiliently flexible skirt portion for yieldably stabilizing the marker against tipping relative to a supportive surface, the body member being connected in upstanding relation to an inner portion of the base and concentric therewith, the base being formed to clear the cone defined by the inside surface of the body member, the bowl portion being sufficiently large relative to the body member and the base being weighted sufficiently that the marker is self-righting, the skirt portion being sufficiently flexible to be deflected against the bowl portion for preserving the self-righting capability of the marker, wherein identical counterparts of the safety marker are stackable with the outside body surface of one marker being in proximate contact with the inside body surface of an adjacent marker.

In a further aspect of the invention, the safety marker includes the elongate hollow frusto-conical body member, the annular base, a flag supported relative to the body member and movable between a deployed position projecting from the body member and a storage position extending proximate the outer surface of the body member; and means for biasing the flag into the deployed position, whereby the storage position is attained and maintained in the stacked condition by the adjacent marker and the deployed position is attained and maintained upon unstacking of the adjacent marker. The flag can include an elongate stem member having a flexible flag member affixed thereto, a portion of the stem member projecting into the body member through a side opening thereof, the stem member being pivotally movable within the opening, the biasing means comprising a compression spring axially disposed within the body member, an upper extremity of the spring being fixedly supported relative to the body member, a lower extremity of the spring being pivotally coupled to an inside extremity of the stem member, the stem member being formed for holding the flag member in outwardly and upwardly projecting relation to the body member in the deployed position, and for holding the flag member against the outside surface of the body member below the side opening in the storage position.

The side opening can be one of a plurality of angularly spaced side openings, the flag being one of a corresponding plurality of flags, the biasing means further including a guide element engaging the lower extremity of the spring and supporting a ring member, inner extremities of each of the stem members being formed for pivotally engaging the ring member at angularly spaced locations about the ring member. The safety marker can further include a cap fastened to an upper extremity of the body member does not project beyond flush with the outer surface of the body member and has an axially oriented opening for receiving a marker accessory.

DRAWINGS

These and other features, aspects, and advantages of the present invention will become better understood with reference to the following description, appended claims, and accompanying drawings, where:

FIG. 3 is a fragmentary sectional elevational view showing portions of two of the safety markers of FIG. 1 in a stacked condition;

FIG. 4 is a fragmentary plan view of a central portion of the safety marker of FIG. 1; and FIG. 5 is a fragmentary sectional view of the marker portion of FIG. 4.

DESCRIPTION

Figure 1:
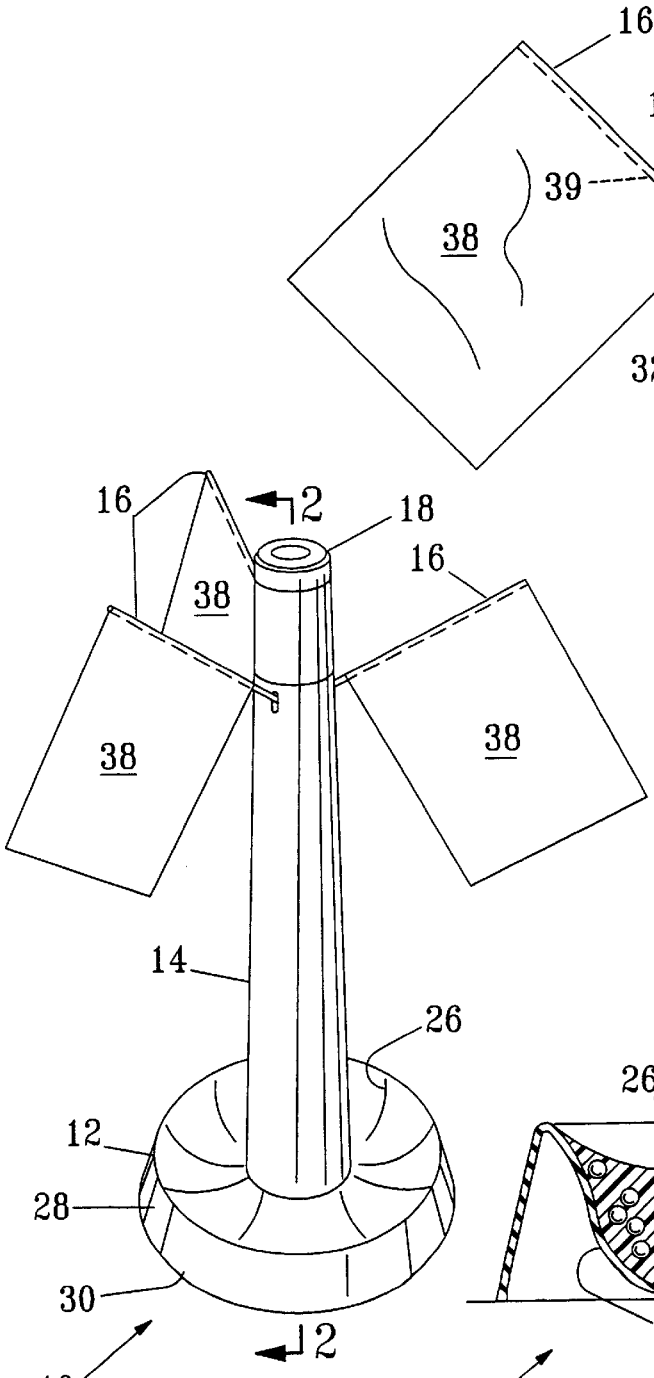
FIG. 1 is a perspective view of a stackable safety marker according to the present invention.

The present invention is directed to a stackable safety marker having flip-up flags, being particularly effective in marking road hazards and the like. With reference to FIGS. 1–4 of the drawings, a safety marker 10 includes a weighted base 12, a hollow frusto-conical body 14 having a longitudinal axis 15, a plurality of flip-up flags 16 that pivotally engage the body 14, and a biasing mechanism 18 for the flags 16.

The base 12 includes an annular wall member 20 that is bonded to a mass element 22, the wall member having a central neck portion 24 that is rigidly connected to a lower extremity of the body 14, and an upwardly concave bowl portion 26 surrounding the neck portion and containing the mass element. The base is formed for clearing a cone that is defined by the inside surface of the body 14 for permitting nested stacking of multiple safety markers 10. The upper surface of the mass element 22 is concave upwardly for enhanced volumetric capacity of the bowl portion 24 without interference with the above-described stacked condition. Thus the safety markers 10 can be relatively tall compared with the plan area of the base 12 while being self-righting, with reduced stacked height as compared with the mass elements not having the preferred concave configuration.

Preferably a flexible skirt portion 28 projects downwardly and outwardly from an upper portion of the bowl portion 26 and having a perimeter extremity 30 that is approximately coplanar with a bottom extremity of the bowl portion. A principal feature of the present invention is that the skirt portion 28 is sufficiently stiff to provide enhanced stabilization of the marker 10 against overturning, yet sufficiently flexible to fold against the bowl portion 26 as indicated by dashed lines in FIG. 2, the weight element 22 and the combined shape of the skirt portion being folded against the bowl portion being effective for righting the safety marker 10 in case the marker does get overturned. A suitable material for the wall member 20 is synthetic rubber. Suitable materials for the mass element 20 are conventional roof sealant composition having fragments or beads of high density such as brass, lead or steel shot imbedded therein. Brass and steel have densities of approximately 0.3 pound per cubic inch. Lead is more preferable for its higher density, yet is significantly more expensive than steel which likely provides a most suitable combination of high density and low cost.

Figure 2:
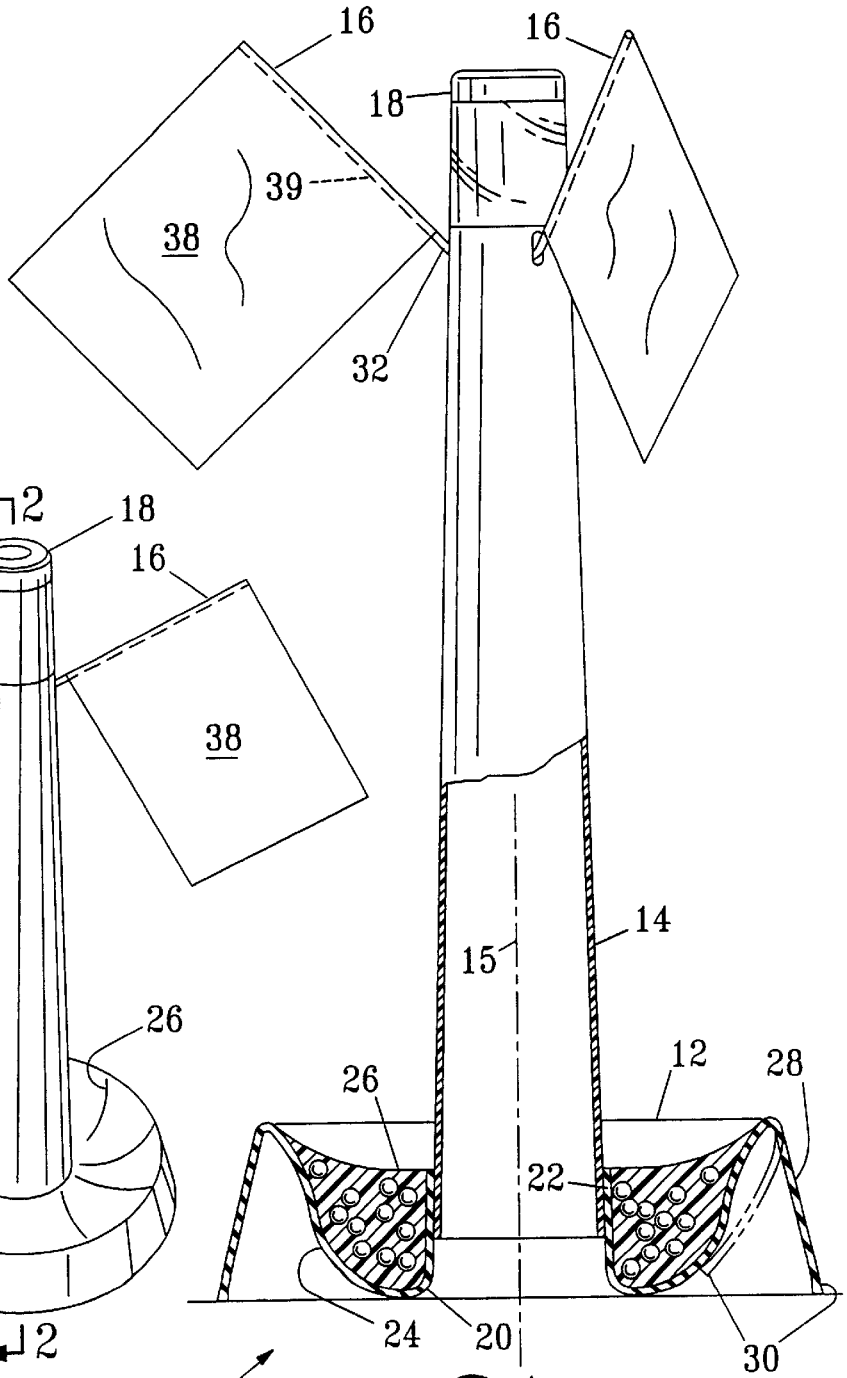
FIG. 2 is a fragmentary sectional elevational view of the safety marker of FIG. 1.

Each flag assembly 16 includes an elongate stem or rod 32 having a J-shaped loop 34 formed at an inner extremity thereof, the rod 32 projecting through a pivot opening 36 that is formed in the body 14, a flexible flag member 38 being bonded along one perimeter edge portion 39 thereof to the rod 32 and terminating at a free end extremity thereof. The biasing mechanism 18 includes a coupling ring 40, a helical compression spring 42, and a retainer cap 44 that threadingly engages a neck member 46, the neck member being bonded to the inside of the body 14 and forming a threaded extension thereof. The coupling ring 40 is assembled from a flanged coupling member 48 having a sleeve portion 49 and a flange portion 50, a wire ring member 52 being concentrically imbedded in the flange portion 50 for pivotally engaging the J-shaped loops 34 of the flag assemblies 16. The spring 42 is interposed between the cap 44 and the coupling ring 40 for downwardly biasing the inner extremities of the rods 32, thereby urging the flag assemblies 16 to respective deployed positions as shown in FIGS. 1 and 2 and the upper portion of FIG. 3, the flag assemblies also having respective retracted positions depending against the outside of the body 14 as shown in the lower portion of FIG. 3, the retracted positions being attained and maintained by nested stacking of plural safety markers 10 wherein inner surfaces of each body 14 contact the flag assemblies 16 and being in proximate contact with outer surfaces of the bodies 14 of adjacently stacked markers 10.

In the exemplary configuration of the marker 10 as shown in the drawings, the coupling member 48 is formed with respective rod slots 54 formed in the flange portion 50 for movably receiving the J-shaped loops 34, the ring member 52 extending circumferentially through the slots 54 for pivotally engaging same, the slots 54 also extending into the sleeve portion 49 and forming openings therein for facilitating assembly with the flag assemblies 16. The coupling member 48 can be molded with the ring member 52 in situ; alternatively, the flange portion 50 can be formed with a groove for radially receiving the ring member 52 as a length of wire that is joined at opposite ends thereof by twisting to form a closed ring, the twisted connecting portion occupying an additional clearance slot that is angularly spaced between a pair of the rod slots 54.

The body 14 can be formed of any suitable rigid plastic material. Suitable proportions of the base 12 and the body 14 are shown in the drawings, the marker 10 having a body height to the top of the cap 44 being approximately double an outside diameter of the skirt perimeter 30. Preferably the flag assemblies 16 in the deployed positions project upwardly and outwardly to a height in excess of the body height. For roadway applications, the safety markers 10 are suitably sized with the body height being approximately 21 inches, the skirt perimeter diameter being approximately 10.5 inches, the upper extremity of the skirt 28 joining the bowl portion at a diameter of approximately 9 inches. On the same scale, the flag members 38 have a length of approximately 5.63 inches and a width in the direction of the rods 32 of approximately 4.9 inches. Similarly, upper extremities of the flag assemblies 16 project to a height of approximately 21.5 inches at a distance of approximately 4.5 inches from the body axis 15, outer extremities of the flag members 38 variously projecting farther outwardly up to approximately 8.5 inches from the axis 15 depending on flexation of the flag members.

A suitable material for the rods 32 is music wire having a diameter of approximately 0.068 inch; a suitable material for the flag members 38 is flexible plastic sheet having a thickness of approximately 0.003 inch. The flag members can be looped once over the rod members, the edge portions 39 being bonded in facing relation to an adjacent portions of the members 38 and to enclosed portions of the rods 32, thereby forming a total thickness of approximately 0.074 inch that is interposed between adjacent bodies 14 in the stacked condition thereof. A suitable configuration of the compression spring 42 has approximately eight active turns of 0.062 inch diameter spring wire, the spring 42 having an inside diameter of approximately 0.70 inch.

The flag assemblies 16 are thus automatically retracted by the action of stacking the markers 10, the stacking being a simple, single-handed operation. Conversely, the flag assemblies 16 are automatically deployed by the action of unstacking the markers 10, the unstacking also being a single-handed operation. Thus the markers can be set out along a highway from stacks that are carried by a moving vehicle, an operator using one hand to sequentially feed and drop the markers 10 close to the ground at desired locations. The operator's other hand is free to grasp a vehicle handle or other steadying device for the operator, or otherwise to manipulate stacks of the markers into position for deployment. In case any marker lands in an upset condition, the above-described self-righting structure of the base 12 acts to restore the upright orientation. Recovery of the markers 10 onto a moving vehicle is similarly accomplished by reversal of the process.

Preferably the retainer cap 44 has an opening 45 for receiving an optional accessory 56 which can be a luminous device. In the exemplary configuration shown in the drawings, a cap insert 58 is interposed between the cap 44 and the compression spring 42, the insert 58 having an internally threaded shank portion 60 for engaging the accessory 56, and a shoulder portion 62 for locating an upper extremity of the spring 32.

As further shown in the drawings, the body 14 is provided with a reflective band 64 for augmenting the visibility of the safety marker 10 such as by reflection of oncoming vehicle headlights. The reflective band can be formed from a strip of conventional reflective adhesive tape. Also, the cap 44 can be formed or coated to have a bright color that contrasts with coloring of the body 14, and one or more additional bands of colored material can be applied to the body for further attracting the attention of approaching persons. Principally, however, the effectiveness of the safety marker 10 as a warning device is due to the presence of the flags 16 being deployed in upwardly and outwardly projecting relation to the body 14.

Although the present invention has been described in considerable detail with reference to certain preferred versions thereof, other versions are possible. Therefore, the spirit and scope of the appended claims should not necessarily be limited to the description of the preferred versions contained herein.

What is claimed is:

1. A safety marker for identifying road hazards and obstructions, comprising:

(a) an elongate hollow frusto-conical body member having an outside surface and an inside surface, the inside surface defining a cone;

(b) a base having an annular bowl-shaped main portion and a resiliently flexible skirt portion extending concentrically outwardly and downwardly from the main portion for yieldably stabilizing the marker against tipping relative to a supportive surface, a perimeter extremity of the skirt portion being approximately flush with a bottom extremity of the main portion, the body member being connected in upstanding relation to an inner portion of the base and concentric therewith, the base being formed to clear the cone defined by the inside surface of the body member, the main portion being sufficiently large relative to the body member and the base being weighted sufficiently that the marker is self-righting, the skirt portion being sufficiently flexible to be deflected against the main portion for preserving the self-righting capability of the marker, wherein identical counterparts of the safety marker are stackable with the outside body surface of one marker being in proximate contact with the inside body surface of the adjacent marker.

2. The safety marker of claim 1, wherein the base comprises a resilient wall member and a weight element filling a bottom portion of the main portion.

3. The safety marker of claim 2, wherein the weight element includes at least 80 percent of a total weight of the safety marker.

4. The safety marker of claim 2, wherein the weight element comprises a multiplicity of fragments having a density of at least approximately 0.3 pounds per cubic inch, the weight elements being imbedded in a resilient binder.

5. The safety marker of claim 4, wherein the binder is adhesively bonded to the wall member.

6. The safety marker of claim 1, wherein an upper surface of the base is upwardly concave for nesting with the main portion of the adjacently stacked safety marker.

7. The safety marker of claim 1, further comprising:

(a) a flag member supported relative to the body member and movable between a deployed position projecting from the body member and a storage position extending proximate the outer surface of the body member; and (b) means for biasing the flag member into the deployed position, whereby the storage position is attained and maintained in the stacked condition by the adjacent marker and the deployed position is attained and maintained upon unstacking of the adjacent marker.

8. A safety marker for identifying road hazards and obstructions, comprising:

(a) an elongate hollow frusto-conical body member having an outside surface and an inside surface, the inside surface defining a cone;

(b) a base, the body member being connected in upstanding relation to an inner portion of the base, the base being formed to clear the cone defined by the inside surface of the body member and protecting outwardly from the outside surface of the body member, identical counterparts of the safety marker being stackable with the outside body surface of one marker being in proximate contact with the inside body surface of an adjacent marker;

(c) a flag supported relative to the body member and movable between a deployed position projecting from the body member and a storage position extending proximate the outer surface of the body member; and (d) means for biasing the flag into the deployed position, whereby the storage position is attained and maintained in the stacked condition by the adjacent marker and the deployed position is attained and maintained upon unstacking of the adjacent marker.

9. The safety marker of claim 8, wherein the flag comprises an elongate stem member having a flexible flag member affixed thereto, a portion of the stem member projecting into the body member through a side opening thereof, the stem member being pivotally movable within the opening, the biasing means comprising a compression spring axially disposed within the body member, an upper extremity of the spring being fixedly supported relative to the body member, a lower extremity of the spring being pivotally coupled to an inside extremity of the stem member, the stem member being formed for holding the flag member in outwardly and upwardly projecting relation to the body member in the deployed position, and for holding the flag member against the outside surface of the body member below the side opening in the storage position.

10. The safety marker of claim 9, wherein the side opening is one of a plurality of angularly spaced side openings, the flag being one of a corresponding plurality of flags, the biasing means further comprising a guide element engaging the lower extremity of the spring and supporting a ring member, inner extremities of each of the stem members being formed for pivotally engaging the ring member at angularly spaced locations about the ring member.

11. The safety marker of claim 8, further comprising a cap fastened to an upper extremity of the body member, the cap not projecting beyond flush with the outer surface of the body member and having an axially oriented opening for receiving a marker accessory.

12. The safety marker of claim 8, wherein the flag is one of a corresponding plurality of flags projecting in approximately equally spaced relation from the body member in deployed positions thereof.

13. The safety marker of claim 8, wherein the base is bowl-shaped, being sufficiently large and massive relative to the body member that the safety marker self-righting.

* * * * *